US010952292B2

(12) United States Patent
Chowdhury et al.

(10) Patent No.: US 10,952,292 B2
(45) Date of Patent: Mar. 16, 2021

(54) PROGRAMMABLE DRIVER FOR VARIABLE LIGHT INTENSITY

(71) Applicant: ABL IP Holding LLC, Atlanta, GA (US)

(72) Inventors: Towfiq M. Chowdhury, Lake Forest, IL (US); Feng Chen, Hoffman Estates, IL (US)

(73) Assignee: ABL IP HOLDING LLC, Atlanta, GA (US)

( * ) Notice: Subject to any disclaimer, the term of this patent is extended or adjusted under 35 U.S.C. 154(b) by 0 days.

(21) Appl. No.: 16/059,606

(22) Filed: Aug. 9, 2018

(65) Prior Publication Data

US 2020/0053849 A1 Feb. 13, 2020

(51) Int. Cl.

*H05B 45/10* (2020.01)
*H05B 47/10* (2020.01)
*H05B 45/30* (2020.01)

(52) U.S. Cl.

CPC ..... *H05B 45/10* (2020.01); *H05B 45/30* (2020.01); *H05B 47/10* (2020.01)

(58) Field of Classification Search

CPC ..... H05B 33/0815; H05B 33/0818; H05B 33/0845; H05B 33/0809; H05B 33/0848; H05B 33/0896; H05B 37/0245; H05B 37/0254; H05B 33/0863; H05B 33/0872; H05B 33/0803; H05B 37/0272; H05B 33/0857; H05B 33/0887; H05B 45/10; H05B 45/14; H05B 45/20; H05B 45/37; H05B 45/30; H05B 45/32; H05B 47/10

See application file for complete search history.

(56) References Cited

U.S. PATENT DOCUMENTS

| | | | |
|---|---|---|---|
| 6,201,351 | B1 | 3/2001 | Rudolph et al. |
| 6,323,598 | B1 | 11/2001 | Guthrie et al. |
| 6,995,355 | B2 | 2/2006 | Rains, Jr. et al. |
| 7,014,336 | B1 | 3/2006 | Ducharme et al. |
| 7,416,312 | B1 | 8/2008 | McDermott |
| 7,497,590 | B2 | 3/2009 | Rains, Jr. et al. |
| 7,520,634 | B2 | 4/2009 | Ducharme et al. |

(Continued)

FOREIGN PATENT DOCUMENTS

| | | |
|---|---|---|
| CN | 106555981 | 4/2017 |
| EP | 2768283 | 8/2014 |

(Continued)

OTHER PUBLICATIONS

U.S. Appl. No. 16/022,892, "Non-Final Office Action," dated Oct. 29, 2018, 6 pages.

(Continued)

*Primary Examiner* — Any Cohen Johnson
*Assistant Examiner* — Syed M Kaiser
(74) *Attorney, Agent, or Firm* — Kilpatrick Townsend & Stockton LLP

(57) ABSTRACT

Certain aspects involve lighting systems in which an intensity can be selectively modified. For instance, a lighting system includes a light source and a programmable device. The programmable device is configured to detect an input resistance and cause a particular current to flow through the light source, thereby causing the light source to emit a particular lumen intensity corresponding to an input resistance.

19 Claims, 6 Drawing Sheets

(56) References Cited

U.S. PATENT DOCUMENTS 7,883,239 B2 2/2011 Rains, Jr. et al.
8,172,415 B2 5/2012 Wegh et al.
8,203,260 B2 6/2012 Li et al.
8,228,002 B2 7/2012 Newman, Jr. et al.
RE43,606 E * 8/2012 Bruwer ..... H05B 39/044 307/140
8,317,362 B2 11/2012 Ku et al.
8,373,362 B2 2/2013 Chemel et al.
8,436,549 B2 5/2013 Hasnain
8,598,809 B2 12/2013 Negley et al.
8,638,045 B2 1/2014 Kunst et al.
8,669,722 B2 3/2014 Yeh et al.
8,710,754 B2 4/2014 Baddela et al.
8,791,642 B2 7/2014 van de Ven et al.
8,872,438 B2 10/2014 Zhou et al.
8,890,436 B2 11/2014 Chou
8,914,312 B2 12/2014 Mclaughlin et al.
8,941,312 B2 1/2015 Mcrae
9,125,271 B2 9/2015 Martins et al.
9,210,760 B2 12/2015 Sanders et al.
9,277,607 B2 3/2016 Ramer et al.
9,289,269 B2 3/2016 Valteau et al.
9,414,457 B2 8/2016 Fukuda et al.
9,538,603 B2 1/2017 Shearer et al.
9,544,951 B1 1/2017 O'Neil et al.
9,719,642 B1 8/2017 Macias
9,730,291 B1 8/2017 Janik et al.
9,736,904 B2 8/2017 Casper et al.
9,801,250 B1 10/2017 Halliwell
9,820,350 B2 11/2017 Pyshos et al.
9,892,693 B1 2/2018 Kumar et al.
9,900,945 B1 2/2018 Janik et al.
9,913,343 B1 3/2018 Ciccarelli et al.
10,091,855 B2 10/2018 Van Winkle
10,117,300 B2 10/2018 Doheny et al.
10,163,405 B2 12/2018 Kumar et al.
10,299,337 B1 5/2019 Chen et al.
10,448,471 B1 10/2019 Chowdhury et al.
2005/0162851 A1 7/2005 Kazar et al.
2005/0243022 A1 11/2005 Negru
2006/0220586 A1 10/2006 Latham
2006/0226795 A1 10/2006 Walter et al.
2006/0238136 A1 10/2006 Johnson, III et al.
2006/0285310 A1 12/2006 Shyu
2007/0159750 A1 7/2007 Peker et al.
2007/0262724 A1 11/2007 Mednik et al.
2008/0130298 A1 6/2008 Negley et al.
2009/0026913 A1 1/2009 Mrakovich
2009/0218960 A1 9/2009 Lyons et al.
2009/0256483 A1* 10/2009 Gehman ..... H05B 41/3924 315/129
2010/0141175 A1 6/2010 Hasnain et al.
2010/0171633 A1* 7/2010 Baker ..... H03K 17/9645 340/815.45
2010/0207534 A1 8/2010 Dowling et al.
2010/0214764 A1 8/2010 Chaves et al.
2010/0283322 A1 11/2010 Wibben
2010/0308738 A1 12/2010 Shteynberg et al.
2011/0058372 A1 3/2011 Lerman et al.
2011/0062872 A1 3/2011 Jin et al.
2011/0068702 A1 3/2011 Van de Ven et al.
2011/0084615 A1 4/2011 Welten
2011/0115407 A1 5/2011 Wibben et al.
2011/0210678 A1 9/2011 Grajcar
2011/0316441 A1* 12/2011 Huynh ..... H05B 45/10 315/291
2012/0080944 A1* 4/2012 Recker ..... H05B 45/37 307/25
2012/0081009 A1 4/2012 Shteynberg
2012/0098460 A1 4/2012 Miyasaka et al.
2012/0242247 A1 9/2012 Hartmann et al.
2012/0253542 A1 10/2012 Nurmi et al.
2012/0286753 A1 11/2012 Zhong et al.
2013/0021580 A1 1/2013 Morgan et al.
2013/0038222 A1 2/2013 Yeh et al.
2013/0049610 A1 2/2013 Chen
2013/0082616 A1 4/2013 Bradford et al.
2013/0140988 A1 6/2013 Maxik et al.
2013/0141013 A1* 6/2013 Kodama ..... F21K 9/64 315/294
2013/0169158 A1* 7/2013 He ..... H05B 47/10 315/121
2013/0200806 A1 8/2013 Chobot
2013/0229125 A1 9/2013 Yan et al.
2013/0249422 A1 9/2013 Kerstens et al.
2013/0249440 A1* 9/2013 Doshi ..... H05B 45/00 315/309
2013/0328500 A1 12/2013 Toda
2013/0343052 A1 12/2013 Yen
2014/0001959 A1 1/2014 Motley et al.
2014/0035472 A1* 2/2014 Raj ..... H05B 45/22 315/185 R
2014/0184076 A1* 7/2014 Murphy ..... H05B 45/14 315/121
2014/0210357 A1 7/2014 Yan et al.
2014/0252967 A1 9/2014 van de Ven et al.
2014/0312777 A1* 10/2014 Shearer ..... H05B 45/20 315/151
2015/0009666 A1 1/2015 Keng et al.
2015/0097489 A1 4/2015 Wu et al.
2015/0245441 A1* 8/2015 McCune, Jr. ..... H05B 45/10 315/185 R
2015/0359061 A1* 12/2015 Adler ..... H05B 47/16 315/153
2016/0007420 A1 1/2016 Gong et al.
2016/0323949 A1* 11/2016 Lee ..... H05B 45/10
2016/0363308 A1 12/2016 Shum
2016/0366746 A1 12/2016 van de Ven et al.
2016/0374177 A1* 12/2016 Chen ..... G06F 3/04883
2017/0019973 A1 1/2017 Beck et al.
2017/0027033 A1 1/2017 Chobot et al.
2017/0086265 A1 3/2017 Akiyama et al.
2017/0086280 A1 3/2017 Boomgaarden et al.
2017/0135186 A1 5/2017 O'Neil et al.
2017/0164440 A1 6/2017 Hu et al.
2017/0238392 A1* 8/2017 Shearer ..... H05B 45/10 315/153
2017/0303363 A1 10/2017 Pyshos et al.
2018/0035510 A1 2/2018 Doheny et al.
2018/0103523 A1 4/2018 Yan et al.
2018/0116029 A1 4/2018 Pyshos et al.
2018/0166026 A1 6/2018 Kumar et al.
2018/0242422 A1 8/2018 Choi et al.
2018/0249547 A1 8/2018 Wang et al.
2018/0310381 A1 10/2018 Bowen et al.
2018/0368232 A1 12/2018 Doheny et al.
2019/0027099 A1 1/2019 Kumar et al.
2019/0037663 A1 1/2019 Van Winkle
2019/0088213 A1 3/2019 Kumar et al.
2019/0141812 A1 5/2019 Chen
2019/0191512 A1* 6/2019 Zeng ..... F21V 23/04
2019/0268984 A1 8/2019 Song et al.
2019/0268991 A1* 8/2019 Li ..... F21V 23/003

FOREIGN PATENT DOCUMENTS

EP 2728972 8/2015
JP 2011258517 12/2011
WO 2011084135 7/2011

OTHER PUBLICATIONS

U.S. Appl. No. 15/991,209, "Non Final Office Action," dated Sep. 7, 2018, 10 pages.
U.S. Appl. No. 16/021,627, "Non Final Office Action," dated Aug. 29, 2018, 14 pages.
U.S. Appl. No. 15/991,209, "Non-Final Office Action," dated Feb. 25, 2019, 9 pages.
U.S. Appl. No. 16/022,892, "Notice of Allowance," dated Mar. 7, 2019, 9 pages.

(56) References Cited

OTHER PUBLICATIONS

U.S. Appl. No. 16/022,892, "Notice of Allowance," dated Jun. 10, 2019, 8 pages.
"2x4 LED Flat Panel", Main Place Lighting, Available Online at: https://shopmainplacelighting.com/collections/commercial-lighting/products/2-x-4-led-flat-panel-1, Accessed From Internet on: May 14, 2019, 3 pages.
"38W LED Panel—Color Selectable", Venture Lighting, Available Online at: https://www.venturelighting.com/led-lighting/indoor-lighting-fixtures/panels-and-troffers/color-selectable-panels/standard-product/pn38592.html, Mar. 19, 2019, 9 pages.
"EASY Lighting Control", Application Guide, OSRAM, Available Online at: www.osram.com/easy, Apr. 2015, 25 pages.
"Human Centric Lighting", HELVAR, Intelligent Colour Product Series, Brochure, Available Online at: https://www.helvar.com/media/filer_public/91/04/9104b3d6-392b-461a-aa48-dd073d33c76b/hcl_flyer-brochure.pdf, Dec. 4, 2017, 1 page.
"IW Cove MX Powercore—Premium Interior Linear LED Cove and Accent Luminaire with Intelligent White Light", Philips Lighting,Product Family Leafelet, Nov. 20, 2017, 4 pages.
"LED Panel 1230 40W Colour Changeable", Fuzion Lighting, Information sheet, Available online at: http://www.fuzionlighting.com.au/product/led-panel-40-cct,, Mar. 19, 2019, 6 pages.
"Noble Pro LED Line Voltage Task Lighting NLLP Series", AFX, R6/17, Ordering sheet, Available Online at: www.AFXinc.com., Accessed From Internet on May 13, 2019, 1 page.
"Par Lite Led", VanWhite, Coemar, User Manual Version 1.0, Jun. 2011, 19 pages.
"Viacon Led-Products", Venture Lighting, Available Online at: https://www.trilux.com/en/products/viacon-led/, Accessed from Internet on: May 13, 2019, 10 pages.
CA3,046,771, "Office Action", dated Feb. 20, 2020, 7 pages.
U.S. Appl. No. 15/991,209 , "Non-Final Office Action", dated Apr. 3, 2020, 17 pages.
U.S. Appl. No. 15/991,209, Notice of Allowance, dated Aug. 4, 2020, 12 pages.
"Led Universal Ceiling Fan Light Kit", Hampton Bay, Use and Care Guide, Nov. 7, 2019, 22 pages.
"LLP LED Light Panel", Main Place Lighting, Specification Sheet, Available Online at: https://cdn.shopify.com/s/files/1/2048/2207/files/LLP-Specification-Sheet-1.pdf, Mar. 19, 2019, 4 pages.
U.S. Appl. No. 15/991,209, Non-Final Office Action dated Sep. 30, 2019, 10 pages.
CA 3040908, Office Action dated May 21, 2020 (3 pages).

* cited by examiner

PROGRAMMABLE DRIVER FOR VARIABLE LIGHT INTENSITY

TECHNICAL FIELD

This disclosure relates generally to lighting systems having multiple groups of light-emitting diodes that can produce illumination of different intensities.

BACKGROUND

Lighting systems include light-emitting diodes ("LEDs") that provide high-quality lighting despite a compact size. Different light-emitting diodes and groups of light-emitting diodes can have different intensities. Thus, lighting fixtures, such as luminaires, are often manufactured in different configurations that provide different intensities that a customer can choose. But stocking LED-based fixtures to accommodate various desirable intensities can require maintaining a relatively large or cumbersome inventory.

SUMMARY

Certain aspects involve lighting systems in which the intensity of the illumination can be selectively modified. For instance, a lighting system includes a light source and a programmable device. The programmable device is configured to detect an input resistance, for example, caused by a combination of a switch and a resistor, and to cause a particular current to flow through the light source, thereby causing the light source to emit a particular lumen intensity corresponding to the input resistance.

These illustrative aspects are mentioned not to limit or define the disclosure, but to provide examples to aid understanding thereof. Additional aspects are discussed in the Detailed Description, and further description is provided there.

BRIEF DESCRIPTION OF THE DRAWINGS

Features, aspects, and advantages of the present disclosure are better understood when the following Detailed Description is read with reference to the accompanying drawings.

DETAILED DESCRIPTION

Aspects described herein involve lighting system that can operate at different intensities. For example, certain aspects involve lighting systems that include one or more light sources (e.g., LED groups). The light sources can be selectively activated, deactivated, or dimmed to configure the lighting system to output a particular level of light intensity.

Figure 1:
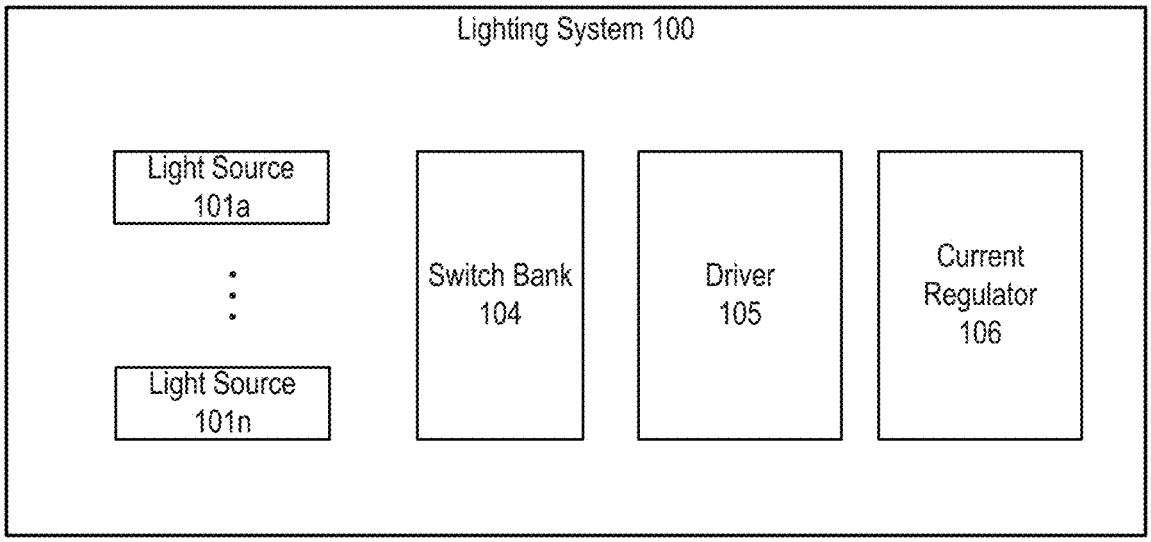
FIG. 1 depicts an example of a lighting system in which different light sources can be adjusted to produce illumination having different intensity levels, according to certain aspects of the present disclosure.

Referring now to the drawings, FIG. 1 depicts an example of a lighting system in which different light sources can be adjusted to produce illumination having different intensity levels, according to certain aspects of the present disclosure. The lighting system 100 can include one or more light sources 101*a-n*, switch bank 104, driver 105, or current regulator 106.

A light source can include any device that can emit light. For illustrative purposes, certain examples described herein with respect to FIGS. 2-5 involve light sources. But other implementations are possible, such as the use of LED groups. Examples of a light source can include one or more LEDs, one or more halogen lighting devices, one or more incandescent lighting devices, one or more laser diodes, one or more organic light emitting diodes, and other light-emitting devices. The particular examples of light sources depicted and/or described herein with respect to FIGS. 2-5 can be replaced with one or more other light sources without departing from the scope of this disclosure.

A light source can emit light at a specific color temperature such as 2700 Kelvin or 3000 Kelvin. In aspects that use more than one light source, each light source can emit light at an identical color temperature, or within a tolerance range of a color temperature. For example, a tolerance range could be +/−100 Kelvin. A first light source emits light at 2660 Kelvin whereas a second light source emits light at 2750 Kelvin, both color temperatures within the tolerance.

Each light source 101*a-n* can include one or more LEDs in any configuration, such as a series or parallel connection. Switch bank 104 can configure lighting system 100 canemit light of different intensities by using different methods. Examples of these methods include switching different light sources on or off, or selectively dimming an light source to a particular intensity level, etc.

Switch bank 104 can include one or more switches. As used herein, a "switching device," or a "switch," can include any mechanism, device, or group of devices that can have different configurations that change one or more connections in one or more electrical circuits of a lighting system. For illustrative purposes, certain examples described herein with respect to FIGS. 2-5 involve switches with one or more throws and poles, slide switches, transistors, etc. But any suitable implementation involving a mechanism, device, or group of devices that change one or more connections in one or more electrical circuits of a lighting system can be used. The particular examples of switching devices depicted and/or described herein with respect to FIGS. 2-5 can be replaced with one or more other switching devices without departing from the scope of this disclosure. Examples of switching devices include DIP switches, slider switches, factory-configured switches, toggles, rotary dials, transistor-based switches, circuit-based switches, etc. Additional examples of switching devices include variable resistors, potentiometers, and the like. For example, a potentiometer can output multiple resistance values, thereby replacing a combination of a switch and a resistor.

In a first example, switch bank 104 configures lighting system 100 to activate a particular number of light sources according to a specified intensity. Light sources 101*a* and 101*b* can each emit light at 1000 lumens. Different selections of switches in switch bank 104 cause different configurations. For instance, a first configuration could include an activation of light source 101*a*, causing an output intensity of 1000 lumens of light. A second configuration could include an activation of both light sources 101*a* and 101*b*, causing an output intensity of 2000 lumens. In a variation, if 1000 lumen is required, then lighting system 100 can randomly select light source 101*a* or 101*b* in order to minimize wear on a particular light source.

In a second example, light source 101*a* can be configured, via switch bank 104, to output light at a first intensity and light source 101*b* can output light at a second intensity. For example, activating light source 101*a* causes 500 lumens of light, activating light source 101*b* causes 1000 lumens of light, and activating both light source 101*a* and 101*b* causes 1500 lumens of light. Such a configuration permits multiple different levels of intensity to be configured.

In a third example, switch bank 104 configures one or more light sources 101*a-n* to lower the intensity of the emitted light to a specified level. For example, light source 101*a* can emit up to 1000 lumens of light, but the activation of a switch in switch bank 104 causes light source to emit only 500 lumens of light. In this manner, adjustable light intensity can be accomplished without multiple light sources.

In each of the above examples, light sources 101*a-n* can be further dimmed using an external dimming input. Examples of external dimming inputs are dimming switches, dimming dials, or smart home systems. A dimming input can include lowering an input voltage to the lighting system.

For illustrative purposes, certain examples described herein with respect to FIGS. 2-5 use specific lumen intensity levels such as "500 lumen." Such intensity levels are for illustrative purposes only. Other lumen values are possible. The particular examples of lumen intensities depicted and/or described herein with respect to FIGS. 2-5 can be replaced with other lumen intensity values without departing from the scope of this disclosure.

Switch bank 104 can include any device having one or more switches or switching devices that provides one or more signals, that vary an input resistance of driver 105 or current regulator 106, or some combination thereof.

Lighting system 100 can include a driver 105 or a current regulator 106. Driver 105 can provide a regulated voltage for the light sources. Driver 105 can be a voltage driver that emits a constant voltage, a current driver that emits a constant current, or a programmable version thereof. For example, as explained further with respect to FIG. 3, different programmed current levels (corresponding to particular intensities) of driver 105 can be activated by various combinations of resistors and switches.

Current regulator 106 can regulate a current that is provided to the light sources. Different current levels can be selected. For example, as explained further with respect to FIG. 4, different programmed current levels (corresponding to particular intensities) of current regulator 106 can be activated by various combinations of resistors and switches.

Driver 105, optionally in conjunction with current regulator 106, can cause the intensity of the light to be adjusted either by dimming one or more light sources 101*a-n* or selectively activating or deactivating one or more light sources 101*a-n*. For example, driver 105 could receive an input voltage from a power source and step the voltage down as appropriate for the light sources.

In some aspects, configuring an intensity of light sources in a lighting system can reduce costs or other resource expenditures for manufacturing multiple lighting systems with different non-configurable intensity levels. In a simplified example, if a lighting system with a target lumen output of 500-lumens is desirable, a luminaire with two 500-lumen light sources can activate only one of the light sources, which reduces manufacturing expenditures as compared to a luminaire that has a fixed output 1000-lumen light source and a fixed output 500-lumen light source.

Figure 2:
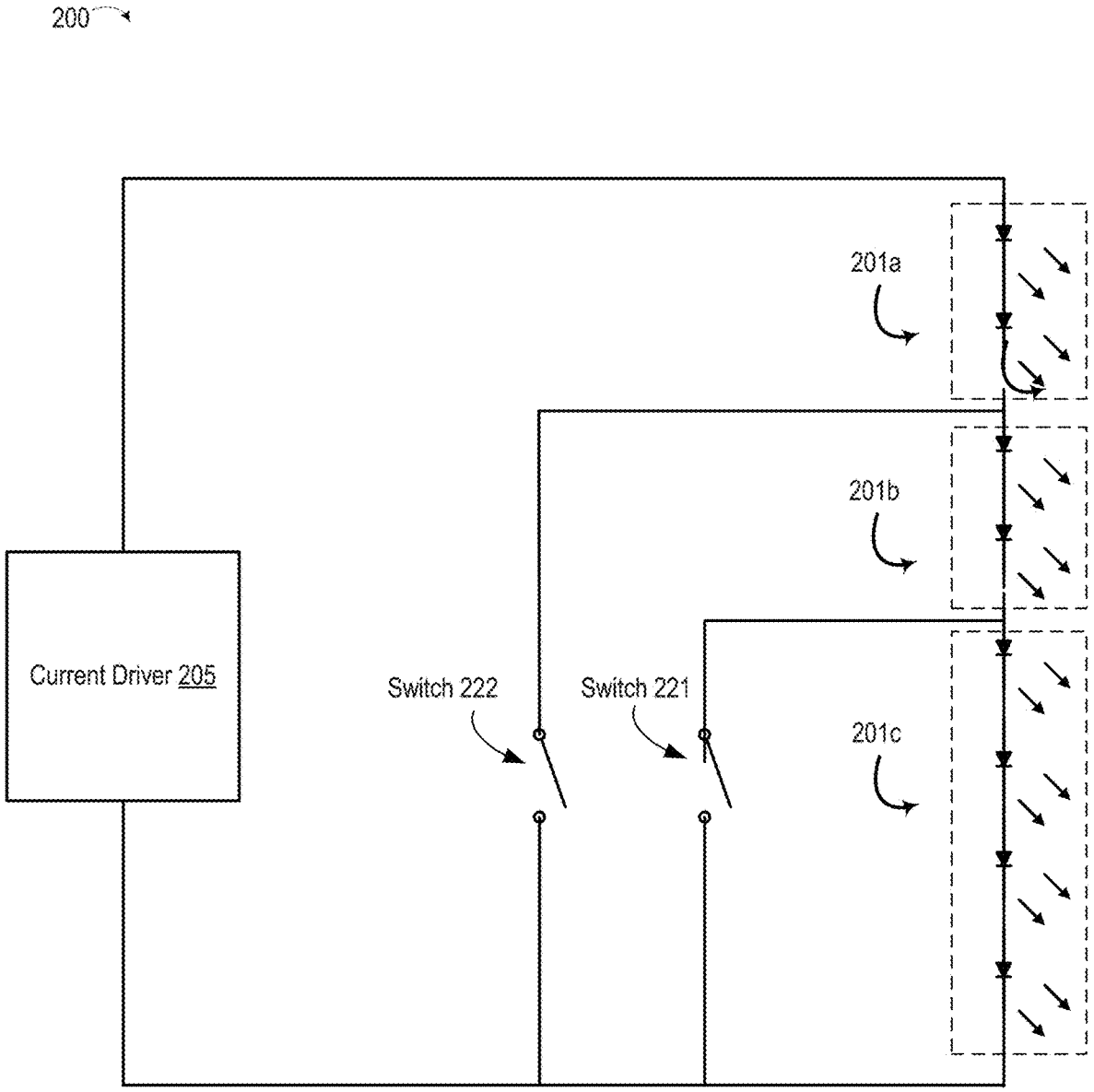
FIG. 2 depicts an example of an implementation of the lighting system from FIG. 1 in which light sources are selectively activated or bypassed to adjust the intensity of the lighting system, according to certain aspects of the present disclosure.

FIG. 2 depicts an example of an implementation of the lighting system from FIG. 1 in which light sources are selectively activated or bypassed to adjust the intensity of the lighting system, according to certain aspects of the present disclosure. In FIG. 2, the lighting system 200, which is an example of implementing the lighting system 100, includes current driver 205, switch 221, switch 222, and LED groups 201*a-c*. Each LED group 201*a-c* can have the same or a different number of LEDs. As depicted, LED groups 201*a* and 201*b* include two LEDs, whereas LED group 201*c* has four LEDs. LED group 201*c* could emit double the brightness of either LED group 201*a* or LED group 201*b*.

As shown in Table 1 below, based on the configuration of switches 221 and 222, the LED groups 201*b* and 201*c* can be activated or deactivated, resulting in configurable intensity levels of low, medium, and high. The terms low, medium, and high are relative. A low intensity is less than a medium intensity and a high intensity. A medium intensity is greater than a low intensity but less than a high intensity. Low, medium, and high intensities can be different lumen values. For example, a low intensity could be 500 lumen, a medium intensity 1000 lumen, and a high intensity 2000 lumen.

Current driver 205 provides an appropriate voltage to LED groups 201*a*, 201*b*, and 201*c*. In one example, switch 222 is closed, thereby shorting LED groups 201*b-c*. Closing switch 222 can cause current to cease flowing through LED groups 201*b* and 201*c*. This cessation of current flow can cause a low intensity of light to be emitted from lighting system 200. In this case, only LED group 201*a* is activated. A low intensity is lower than the other configurations, medium and high. For example a low intensity could be 500 lumen. If switch 222 is closed, then closing switch 221 does not change the intensity because LED groups 201*b* and 201*c* are deactivated because current is not flowing through LED groups 201*b* and 201*c*.

TABLE 1

| Switch 221 | Switch 222 | Lumen Output |
|---|---|---|
| OPEN | OPEN | HIGH |
| CLOSED | OPEN | MEDIUM |
| OPEN | CLOSED | LOW |
| CLOSE | CLOSED | LOW |

Opening switches 221 and 222 switch 221 causes a high intensity of light to be emitted. In this configuration, LED groups 201*a-c* are activated. Opening switch 222 and closing switch 221 causes only LED groups 201*a* and 201*b* to be activated, which is a medium level of light.

Although FIG. 2 and Table 1 depict two configuration switches 221 and 222, fewer or a greater number of configuration switches are possible, resulting in a different number of possible intensity levels. Each additional switch can short a path around one or more LED groups, causing the LED groups to deactivate.

In a simplified example, a professional installer, store clerk, manufacturing system, technician, or user can configure switches 221 and 222 such that the current driver 205 causes LED groups 201*a-c* to be activated and a particular intensity level is outputted by the lighting system 200. For example, a professional installer may configure lighting system 200 to operate with a particular intensity (e.g., 2000 lumen), then install the lighting system in a customer's premises. Similarly, a professional installer may configure another lighting system 200 with a higher intensity (e.g., 4000 lumen) of light and install the lighting system in the customer's basement, where more light is desired.

Figure 3:
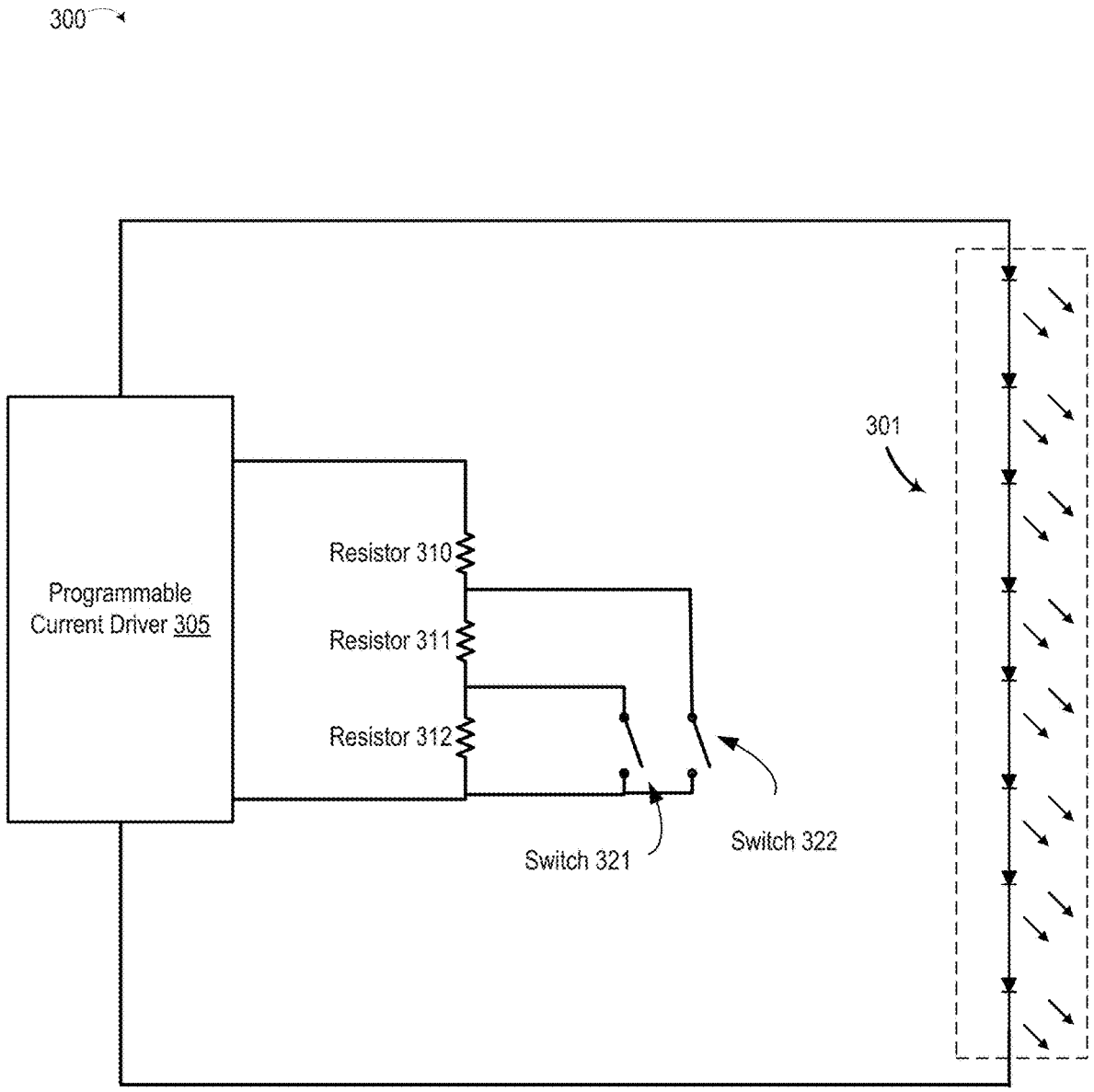
FIG. 3 depicts the lighting system of FIG. 1 in which switches can be used to control a resistance presented to an input of a driver that controls an intensity level, according to certain aspects of the present disclosure.

FIG. 3 depicts a lighting system 300 in which switches can be used to control a resistance presented to an input of a driver that controls an intensity level, according to certain aspects of the present disclosure. In FIG. 3, the lighting system 300, which is an example of implementing the lighting system 100, includes programmable current driver 305, resistors 310-312, switch 321, switch 322, and LED group 301.

Programmable current driver 305 is configurable by switch 321 and switch 322. More specifically, different configurations of resistors 310-312, switch 321, and switch 322 cause different combinations of resistance to be presented to programmable current driver 305. Presenting different combinations of resistance can cause programmable current driver 305 to adjust the output current according to a particular resistance. The resistance presented to programmable current driver 305, as configured by resistors 310-312, switch 321, and switch 322, can be referred to as the Rset value. For example, the Rset value of 1 kOhm can cause the driver to allow 500 mA to flow through a LED group. A current of 500 mA flowing through LED group 301 causes LED group 301 to emit light of a particular intensity.

As depicted in Table 2, the combination of switch 321 and 322 results in three different configurations of intensity: low, medium, and high. Opening a particular switch can cause a current flow through a resistor that is in parallel with the switch. Conversely, closing a particular switch can cause a current path through one or more resistors to be shorted, thereby altering the current flow through the light source.

TABLE 2

| Switch 321 | Switch 322 | Lumen Package |
|---|---|---|
| OPEN | OPEN | HIGH |
| CLOSED | OPEN | MEDIUM |
| OPEN | CLOSED | LOW |
| CLOSED | CLOSED | LOW |

In a first configuration, switches 321 and 322 being open can cause a resistance to be seen by programmable current driver 305 that is the sum of the resistance values of resistors 310, 311, and 312. The programmable current driver 305 can output an amount of current that causes LED group 301 to output a high lumen output.

In a second configuration, switch 321 being closed and switch 322 being open can cause a resistance to be seen by programmable current driver 305 that is the sum of the resistance values of resistors 310 and 311. The programmable current driver 305 can output an amount of current necessary to cause LED group 301 to output a medium lumen output.

In a third configuration, switch 321 being open and switch 322 being closed can cause a resistance to be seen by programmable current driver 305 that is the resistance value of resistor 310. The programmable current driver 305 outputs an amount of current necessary to cause LED group 301 to output a low lumen output. An identical low lumen output is obtained when switch 321 is closed and switch 322 is closed, as closing switch 321 does not change the resistance if switch 322 is closed.

Figure 4:
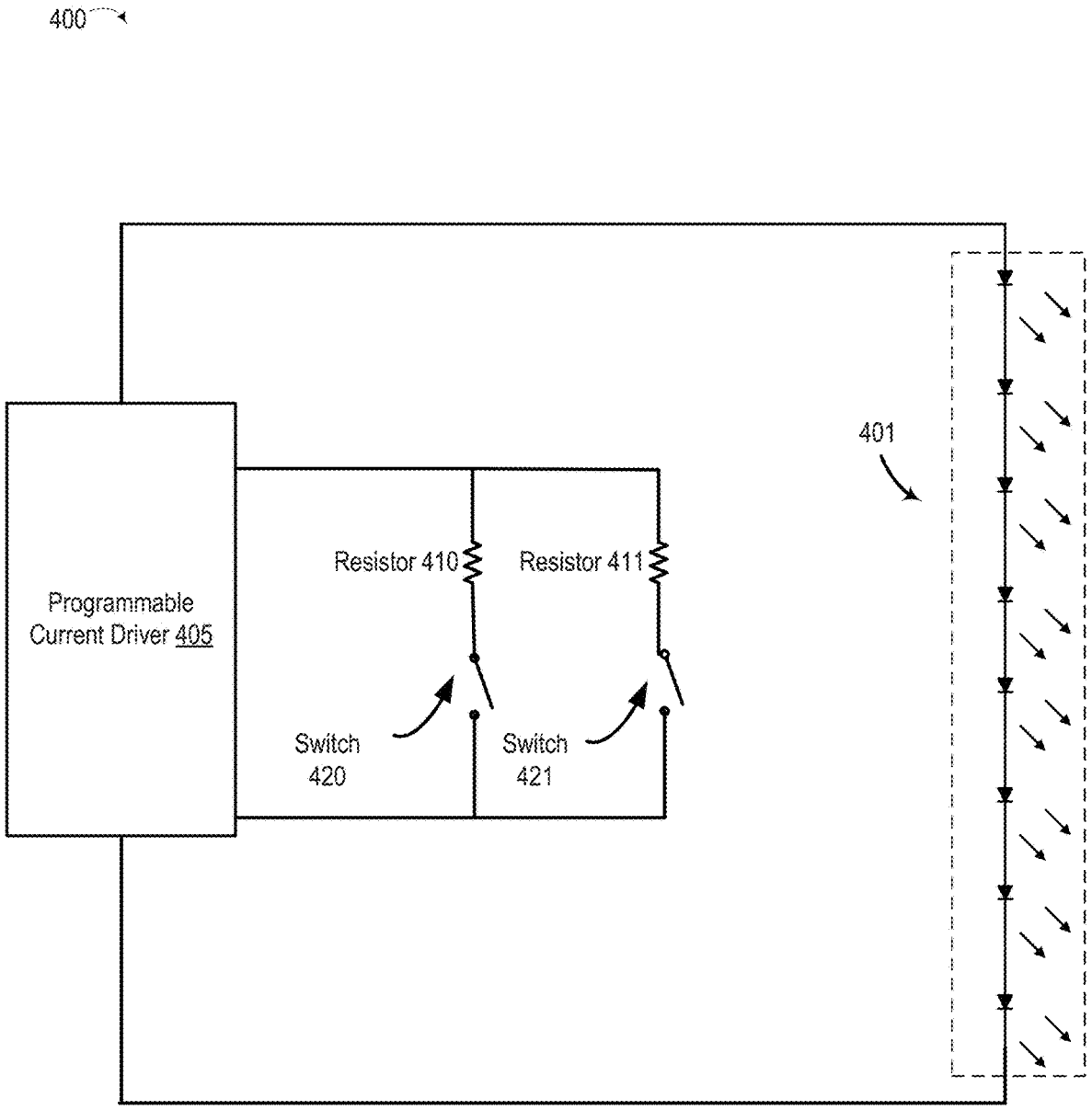
FIG. 4 depicts the lighting system of FIG. 1 in which an additional configuration of switches can be used to control a resistance presented to an input of a driver that controls an intensity level, according to certain aspects of the present disclosure.

FIG. 4 depicts the lighting system of FIG. 1 in which an additional configuration of switches can be used to control a resistance presented to an input of a driver that controls an intensity level, according to certain aspects of the present disclosure. In FIG. 4, the lighting system 400, which is an example of implementing the lighting system 100, includes programmable current driver 405, resistor 410, resistor 411, switch 420, switch 421, and LED group 401. As depicted, a combination of switch 420 and resistor 410 is in parallel with a combination of switch 412 and resistor 411. But other configurations are possible.

Programmable current driver 405 is configurable by switches 420-421. More specifically, different configurations of resistors 410-411 and switches 420-421 cause different combinations of resistance to be presented to programmable current driver 405. Presenting different combinations of resistance can cause programmable current driver 405 to adjust the output current according to a particular resistance. The resistance presented to programmable current driver 405, as configured by resistors 410-411 and switches 420-421, can be referred to as the Rset value. For example, the Rset value of 1 kOhm can cause the driver to allow 500 mA to flow through a LED group. A current of 500 mA flowing through LED group 401 causes LED group 401 to emit light of a particular intensity.

As depicted in Table 3, the combination of switches 420-421 results in four different configurations of intensity: very low, low, medium, and high. Opening a particular switch can cause a current flow through a different path. Conversely, closing a particular switch can cause a current path through one or more resistors to be completed, causing the programmable device to be presented with a resistance equal to the particular resistor.

TABLE 3

| Switch 420 | Switch 421 | Lumen Package |
|---|---|---|
| OPEN | OPEN | HIGH |
| CLOSED | OPEN | MEDIUM |
| OPEN | CLOSED | LOW |
| CLOSED | CLOSED | VERY LOW |

In a first configuration, switches 420 and 421 being open can cause an extremely high, or infinite, resistance to be seen by programmable current driver 405. As a result, the programmable current driver 405 can output an amount of current that causes LED group 401 to output a high lumen output.

In a second configuration, switch 420 being closed and switch 421 being open can cause a resistance to be seen by programmable current driver 405 that is equal the resistance value of resistor 410. The programmable current driver 405 can output an amount of current necessary to cause LED group 401 to output a medium lumen output.

In a third configuration, switch 420 being open and switch 421 being closed can cause a resistance to be seen by programmable current driver 405 that is the resistance value of resistor 411. The programmable current driver 405 outputs an amount of current necessary to cause LED group 401 to output a low lumen output.

In a fourth configuration, both switches 420 and 421 being closed causes a resistance to be seen by programmable current driver 405 that is equal to a parallel combination of resistors 410 and 411. In response, the programmable current driver outputs an amount of current necessary to cause LED group 401 to cause a very low lumen output.

Figure 5:
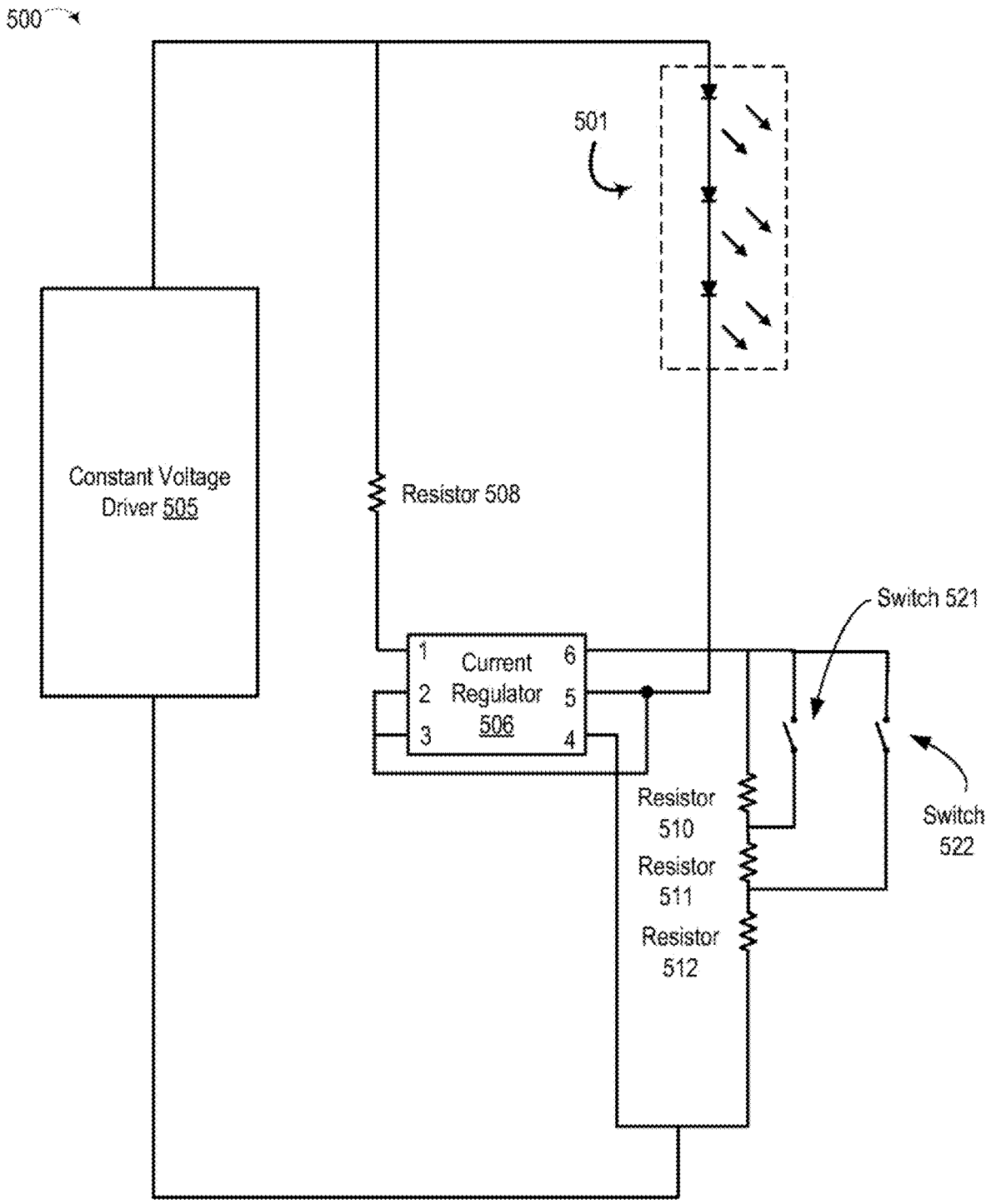
FIG. 5 depicts the lighting system of FIG. 1 in which switches can be used to control a resistance presented to an input to a current regulator that controls an intensity level, according to certain aspects of the present disclosure.

FIG. 5 depicts a lighting system 500 in which switches can be used to control a resistance presented to an input to a current regulator that controls an intensity level, according to certain aspects of the present disclosure. In FIG. 5, the lighting system 500, which an example of implementing the lighting system 100, includes constant voltage driver 505, resistor 508, current regulator 506, resistors 510-512, switch 521, switch 522, and LED group 501.

Constant voltage driver 505 provides a constant output voltage suitable for LED group 501. Examples of suitable voltages are 5 Volts or 12 Volts. Current regulator 506 provides an appropriate amount of current for a lumen intensity level specified configured by switches 521 and 522 in conjunction with resistors 510-512.

Current regulator 506 provides a configurable current. As depicted, current regulator 506 has six inputs (labeled 1-6). Input 1 connects to the constant voltage driver 505 via resistor 508. Input 5 connects to another output from constant voltage driver 505. As depicted, inputs 2, 3, and 5 are each connected to the cathode-size of LED group 501. Inputs 5 and 6 receive a particular resistance as determined by resistors 510-512 and switches 521 and 522.

As depicted in Table 4, the combination of switch 521 and 522 results in three different configurations of intensity. In a first configuration, switch 521 being open and switch 522 being open causes a resistance to be seen by current regulator 506 that is the sum of the resistance values of resistors 510, 511, and 512. The current regulator 506 outputs an amount of current necessary to cause LED group 501 to output a low lumen output.

TABLE 4

| Switch 521 | Switch 522 | Lumen Package |
|---|---|---|
| OPEN | OPEN | LOW |
| CLOSED | OPEN | MEDIUM |
| OPEN | CLOSED | HIGH |
| CLOSED | CLOSED | HIGH |

In a second configuration, switch 521 being closed and switch 522 being open causes a resistance to be seen by current regulator 506 that is the sum of the resistance values of resistors 511 and 512. The current regulator 506 outputs an amount of current necessary to cause LED group 501 to output a medium lumen output.

In a third configuration, switch 521 being open and switch 522 being closed causes a resistance to be seen by current regulator 506 that is the resistance value of resistor 512. The current regulator 506 outputs an amount of current necessary to cause LED group 501 to output a high lumen output. An identical low lumen output is obtained when switch 521 is closed and switch 522 is closed, as closing switch 521 does not change the resistance if switch 522 is closed.

Figure 6:
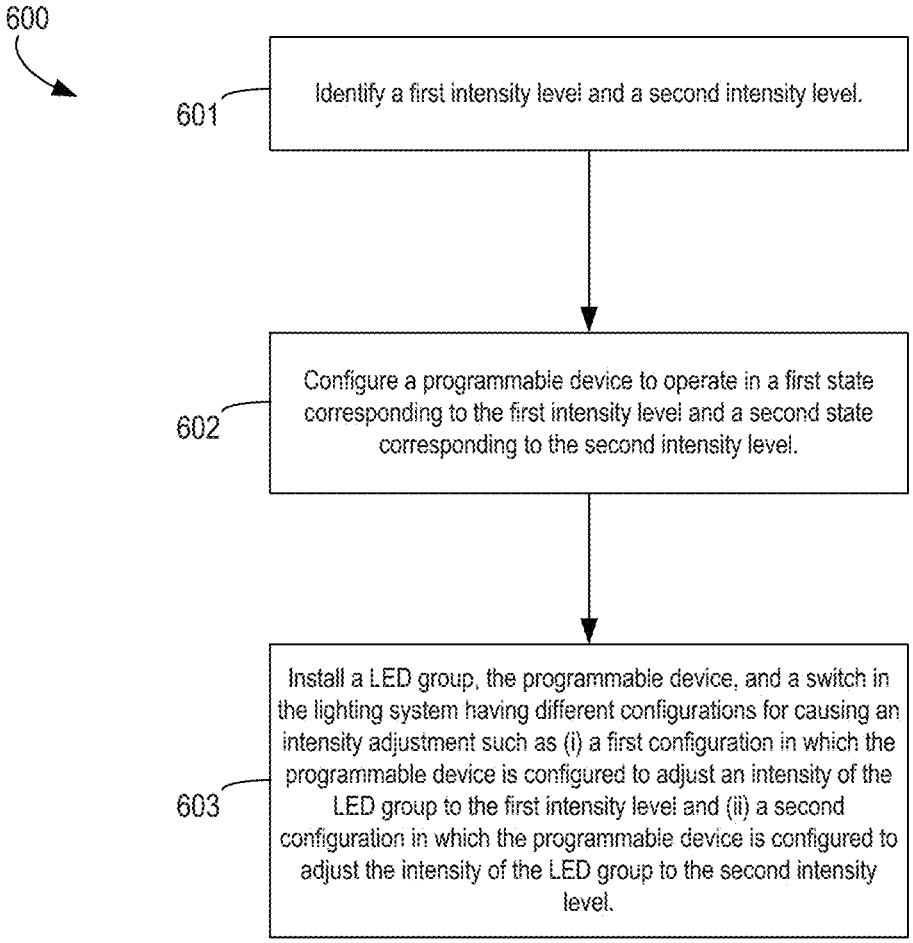
FIG. 6 depicts an example of a method for manufacturing one or more lighting systems in which different LED groups can be selectively activated to produce illumination having different intensities.

FIG. 6 depicts an example of a method for manufacturing one or more lighting systems in which different LED groups can be selectively activated to produce illumination having different intensities. Method 600 can be used to manufacture one or more of the lighting systems 100, 200, 300, 400, as well as variants thereof. For illustrative purposes, the method 600 is described with respect to the examples depicted in FIGS. 1-4. But other implementations are possible.

At block 601, method 600 involves identifying a first intensity level and a second intensity level. In some aspects, identifying these values can involve accessing these values from files. In one example, a computing device executing suitable design software can access specification data from one or more files stored in a non-transitory computer-readable medium. In another example, a technician, can access specification data from one or more files. The files can include specifications for a luminaire or other lighting system. The specification data can include, for example, one or more dimming curves. The specification data can include additional parameters such as different target lumen outputs. In some aspects, the specification data can include a threshold tolerance with respect to the dimming curves. The computing device can identify the target lumen outputs from the specification data. In some aspects, a technician can perform one or more of these operations.

At block 602, method 600 involves configuring a programmable device to operate in a first state corresponding to the first intensity level and a second state corresponding to the second intensity level. A programmable device can include a voltage regulator, current regulator, voltage driver, current driver, or any other device that can alter current or voltage to a predefined level.

For example, the computing device can access the schematic diagram that includes a particular configuration of switches necessary for a particular lumen output or LED group configuration, such as those depicted Tables 1-4. From the configuration, the computing device can configure a set of switches, or make the appropriate connections such that the driver is appropriately configured.

At block 603, method 600 involves installing a LED group, the driver, and a switch in the lighting system having different configurations for causing an intensity adjustment to different intensity levels. For instance, the driver can adjust an intensity of the LED group to the first intensity level in a first configuration and adjust the intensity of the LED group to the second intensity level in a second configuration. The driver can be a voltage driver, a current driver, or a programmable version thereof. In some aspects, the computing device can output a schematic diagram or other data that includes circuits (e.g., one or more of the circuits depicted in FIGS. 1-4) that include one or more LED groups, a switch bank, a driver, or a current regulator.

In some aspects, the outputted schematic diagram or other data can be provided (e.g., by the computing device or via a transfer on a non-transitory computer-readable medium) to one or more manufacturing systems. A manufacturing system assemble one or more LED groups, a switch bank, a microcontroller, and associated circuitry into the lighting system. For example, the manufacturing system can position one or more of the LED groups, position one or more switches, position a current driver, and connect the LED groups, switches, and current driver to a wiring system (e.g., a printed circuit board or other set of conductors) that implements the outputted schematic diagram or other data.

In additional or alternative aspects, the outputted schematic diagram or other data can be provided (e.g., by the computing device or via a transfer on a non-transitory computer-readable medium) to one or more technicians. The technician can manually assemble the LED groups, the switch bank, and the current driver into the lighting system. For instance, the technician can position one or more of the LED groups, position one or more switches, position the current driver, and connect the LED groups and switches to a wiring system that implements the outputted schematic diagram or other data.

In some aspects, installing the LED groups with the switch involves implementing lighting system 200, 300, 400, or 500. For instance, a manufacturing system or technician could position one or more switches between the first LED group and the second LED group in a first path that includes a current driver. A manufacturing system or technician could also position one or more switches between the first LED group and a third LED group in a second path that includes the current driver. The switch could be a slide switch, as described above with respect to FIGS. 2-5. The slide switch could have a first position that implements the first configuration and a second position that implements the second configuration.

General Considerations

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Unless specifically stated otherwise, it is appreciated that throughout this specification discussions utilizing terms such as "computing," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provide a result conditioned on one or more inputs. Suitable computing devices include multi-purpose microprocessor-based computer systems accessing stored software that programs or configures the computing system from a general purpose computing apparatus to a specialized computing apparatus implementing one or more aspects of the present subject matter. Any suitable programming, scripting, or other type of language or combinations of languages may be used to implement the teachings contained herein in software to be used in programming or configuring a computing device.

Aspects of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

The foregoing description, including illustrated examples, has been presented only for the purpose of illustration and description and is not intended to be exhaustive or to limit the invention to the precise forms disclosed. Numerous modifications, adaptations, and uses thereof will be apparent to those skilled in the art without departing from the scope of this disclosure. Aspects and features from each example disclosed can be combined with any other example.

The invention claimed is:

1. A lighting system comprising:

an output circuit comprising a light source;

an input circuit comprising:

a switch configured to receive a selection of a first intensity level or a second intensity level; and a resistor connected in parallel or in series with the switch, wherein:

a first combination of the switch and the resistor causes a first input resistance that corresponds to the first intensity level; and a second combination of the switch and the resistor causes a second input resistance that corresponds to the second intensity level; and a current driver connected to the input circuit and the output circuit and configured to:

(i) detect, on the input circuit, the first input resistance, wherein the first input resistance is independent of any detection of any current through the light source; and in response to detecting the first input resistance, cause a first current to flow on the output circuit to the light source, causing the light source to emit light at the first intensity level, and (ii) detect, on the input circuit, the second input resistance, wherein the second input resistance is independent of any detection of any current through the light source, and in response to detecting the second input resistance, cause a second current to flow on the output circuit to the light source, causing the light source to emit light at the second intensity level.

2. The lighting system of claim 1, wherein the light source is configured to emit light of a first color temperature at the first intensity level and light of a second color temperature at the second intensity level, wherein the first color temperature and the second color temperature are within a tolerance range.

3. The lighting system of claim 1, further comprising an additional switch and an additional resistor, wherein the resistor is in a first series combination with the switch, and wherein the first input resistance equals a resistance value of the resistor, and wherein the second input resistance equals a resistance of a second series combination of the additional switch in a closed position with the additional resistor, wherein the first series combination is in parallel with the second series combination.

4. The lighting system of claim 1, wherein the light source is dimmable by a reduction in input voltage to the lighting system.

5. The lighting system of claim 1, wherein the switch comprises a slide switch movable between a first position and a second position, wherein the switch being in the first position causes the first input resistance, and wherein the switch being in the second position causes the second input resistance.

6. The lighting system of claim 1, further comprising an additional switch connected in parallel with a combination of an additional resistor connected in series with the resistor, wherein the additional switch is further configured to operate in conjunction with the additional resistor to provide a third input resistance that configures the current driver to provide a third current to the light source corresponding to a third intensity level.

7. The lighting system of claim 6, further comprising a voltage driver configured to provide a constant voltage, wherein the current driver adjusts a current drawn from the voltage driver.

8. A lighting system comprising:

a lighting source;

a programmable device configured for controlling current delivered to the light source, the programmable device having a first terminal, a second terminal, and a third terminal;

a first current path that includes the light source connected to the first terminal; and a second current path separate from the first current path, wherein the second current path comprises a switch and a resistor, starts at the second terminal, and terminates at the third terminal, wherein the first current path does not include the second terminal or the third terminal, wherein the programmable device is a current driver that is configured to:

(i) detect, on the second current path, a first input resistance formed by the switch and the resistor, and in response to detecting the first input resistance;

cause a first current to flow through the first current path, thereby causing the light source to emit light at a first intensity level; and (ii) detect, on the second current path, a second input resistance formed by the switch and the resistor, and in response to detecting the second input resistance, cause a second current to flow through the first current path, thereby causing the light source to emit light at a second intensity level.

9. The programmable device of claim 8, wherein the current driver is configured to cause the light source emit light of a first color temperature at the first intensity level and light of a second color temperature at the second intensity level.

10. The programmable device of claim 9, wherein the first color temperature and the second color temperature are within a tolerance range.

11. The current driver of claim 8, wherein the programmable device comprises a voltage driver configured to provide a constant voltage, wherein the current driver adjusts a current drawn from the voltage driver.

12. The programmable device of claim 8, further comprising a potentiometer configured to provide, to the current driver, the first input resistance and the second input resistance.

13. The lighting system of claim 8, wherein the first current path is not connected to the current second path.

14. The lighting system of claim 8, wherein the first input resistance and the second input resistance are independent of a current flow through the light source.

15. The lighting system of claim 8, further comprising a voltage regulator configured to provide a constant voltage, wherein the current driver adjusts a current drawn from the voltage regulator.

16. A method of manufacturing a lighting system, the method comprising:

identifying a first intensity level and a second intensity level;

configuring a switch and a resistor such that a first combination of the switch and the resistor is configured to cause a first input resistance and a second combination of the switch and the resistor is configured to cause a second input resistance;

configuring a first current path that includes a light source connected to a first terminal and configuring a second current path separate from the first current path, wherein the second current path comprises a switch and a resistor, starts at a second terminal, and terminates at a third terminal, wherein the first current path does not include the second terminal or the third terminal;

configuring a current driver to operate in a first state corresponding to the first intensity level and a second state corresponding to the second intensity level; and installing the light source, the current driver, the resistor, the first current path, the second current path, the first terminal, the second terminal, and the third terminal, and the switch in the lighting system, the lighting system comprising:

(i) a first configuration in which the current driver is configured to adjust an intensity of the light source to the first intensity level, the first configuration caused by the first combination of the switch and the resistor; and (ii) a second configuration in which the current driver is configured to adjust the intensity of the light source to the second intensity level, the second configuration caused by the second combination of the switch and the resistor.

17. The method of claim 16, wherein the switch is a slide switch having a first position that implements the first configuration and having a second position that implements the second configuration.

18. The method of claim 16, further comprising a voltage regulator configured to provide a constant voltage, wherein the current driver adjusts a current drawn from the voltage regulator.

19. The method of claim 16, wherein the switch is a slide switch having a first position that implements the first configuration and having a second position that implements the second configuration.

* * * * *